US009517549B2

(12) United States Patent
East

(10) Patent No.: US 9,517,549 B2
(45) Date of Patent: Dec. 13, 2016

(54) SOCKET TOOL SET

(71) Applicant: Gordon H. East, Salem, SC (US)

(72) Inventor: Gordon H. East, Salem, SC (US)

( * ) Notice: Subject to any disclaimer, the term of this patent is extended or adjusted under 35 U.S.C. 154(b) by 411 days.

(21) Appl. No.: 14/082,106

(22) Filed: Nov. 16, 2013

(65) Prior Publication Data

US 2015/0135504 A1 May 21, 2015

(51) Int. Cl.

| | |
|---|---|
| ***B25B 27/00*** | (2006.01) |
| ***B25B 13/06*** | (2006.01) |
| ***B25B 23/00*** | (2006.01) |
| ***B25B 13/10*** | (2006.01) |
| ***B25B 13/56*** | (2006.01) |

(52) U.S. Cl.

CPC ..... *B25B 13/06* (2013.01); *B25B 13/102* (2013.01); *B25B 13/56* (2013.01); *B25B 23/0035* (2013.01); *B25B 27/0035* (2013.01); *Y10T 29/49822* (2015.01); *Y10T 29/49826* (2015.01)

(58) Field of Classification Search

CPC ..... B25B 27/10; B25B 27/16; B25B 15/008; B25B 13/44; B25B 13/06

See application file for complete search history.

(56) References Cited

U.S. PATENT DOCUMENTS

| | | | | |
|---|---|---|---|---|
| 851,068 | A | 4/1907 | Cowell | |
| 2,502,587 | A | 4/1950 | Phipps | |
| 2,991,678 | A | 7/1961 | Adolphson | |
| 4,620,460 | A | 11/1986 | Gonzales, Jr. | |
| 4,798,111 | A | 1/1989 | Cheeseman | |
| 4,882,958 | A * | 11/1989 | McNeeley | B25B 13/56 81/124.4 |
| 5,074,174 | A | 12/1991 | Kim | |
| 5,228,570 | A * | 7/1993 | Robinson | B25H 3/06 206/375 |
| 6,330,844 | B1 | 12/2001 | Walker | |
| 2002/0011135 | A1* | 1/2002 | Hall | B25B 13/06 81/124.4 |
| 2006/0191383 | A1 | 8/2006 | Woods et al. | |
| 2013/0014616 | A1* | 1/2013 | Putsch | B25B 13/005 81/121.1 |
| 2015/0135504 | A1* | 5/2015 | East | B25B 13/102 29/426.5 |
| 2015/0217432 | A1* | 8/2015 | Gadd | B25B 15/008 81/439 |

* cited by examiner

*Primary Examiner* — Lee D Wilson
(74) *Attorney, Agent, or Firm* — Memminger E. Wiggins

(57) ABSTRACT

A socket tool set having a plurality of individual sockets with varying diameters and lengths coaxially nested within one another and a key which is slidably engaged with said sockets during storage of the tool set. During use the key operationally engages an individual socket and serves as an extension to said socket.

13 Claims, 4 Drawing Sheets

SOCKET TOOL SET

FIELD OF THE INVENTION

This invention is directed towards a socket tool set designed to permit use in recessed areas with limited access. Additionally, the socket tool set includes sockets of different diameters which can be nested within each other for convenient storage of the set individually, or as a single tool in a set of numerous tools. In similar fashion the key that is used to engage the sockets individually during use of such socket can be nested within the inner most socket during storage.

BACKGROUND OF THE INVENTION

Socket tool sets with ¼ inch or ⅜ inch square drives and socket sets known as OEM (original equipment manufacturer) sockets, "after-market specialty sockets", and "sparkplug sockets" suffer from numerous limitations. These tool sets are generally bulky and as such present challenges regarding their storage and transportation. Additionally, these tool sets do not support a "nesting" configuration for storage and essentially consume the combined total space equal to all of the sockets included in the set. The sockets themselves are heavy and require a specific sized drive ratchet or breaker bar in order to exert rotational torque to loosen or tighten a fastener or sparkplug. The drive ratchet is not compact, nor is its use optional.

Typically, sockets within these sets will have a set length. Their assembled tool lengths can only be changed by using a different socket length, or by adding pre-set extensions commonly available in 3 inch or 6 inch lengths. Additionally, the assembled lengths of conventional sockets are increased by the "head" or gear/rotation part of the drive ratchet. This additional length added to a socket can result in space/clearance issues, and thus prevent the use of the socket in areas with limited or restricted access.

Moreover, sockets of this type fit around the outside circumference of the head of the fastener, sparkplug, or machined object. These sockets do not offer any means to apply pressure and turning motion to aid with thread engagement for tightening or loosening fasteners or sparkplugs. This limitation often makes the installation of fasteners, sparkplugs or machined objects in recessed or restricted areas difficult.

These socket tool sets also do not provide a positive extraction of the socket should it become lodged in a restricted space such as an engine part or a restrictively enclosed area. Under these circumstances the socket simply pulls off the drive ratchet to which it was attached and remains in the recessed/interference area. It is not uncommon for sockets of this type to be sold as "singles" and designed to fit only one wrench size. Finally, sockets of this type generally do not offer multiple turning tool options and will not accept open-end, boxed-end, sockets, extensions, ratchets, nor can a torque wrenches be used when precise tightening is required.

Accordingly, there remains room for improvement and variation within the art.

SUMMARY OF THE INVENTION

It is at least one of the present embodiments to provide a socket tool set comprising a plurality of individual sockets with varying diameters and lengths. These sockets are coaxially nested within one another and a key is slidably engaged with the sockets in this storage configuration. When a socket is in use the key operationally engaging the individual socket and serves as an extension to the socket.

It is a further aspect of at least one of the present embodiments to provide a socket which includes a proximal end, a distal end, an engagement plate, and a tubular member. The proximal end engages devices such as fasteners, bolts, nuts, sparkplugs, and the like. Additionally, the proximal end of the socket having a shape selected from the group including, but not limited to, square, pentagonal, hexagonal, heptagonal, octagonal, or any other shape known in the art of fasteners and sparkplugs. The distal end includes an engagement plate with an aperture to receive the key and thereby permitting the key to slidably and torsionally engage the socket. The engagement plate having an inner engagement surface and an outer engagement surface. The tubular member that connect the proximal end of the socket to its distal end.

It is a further aspect of at least one of the present embodiments to provide a key which includes a longitudinal shank body, a flat head, a spring loaded detent assembly, and a traverse hole. The longitudinal shank body extends from a proximal end to a distal end having a shape and a diameter that permits the shank body to slidably and torsionally engage the aperture of the engagement plate. The flat head having an upper surface and a lower surface with the lower surface being attached to the distal end of the shank body, the lower surface of the flat head engaging the inner engagement surface of the engagement plate when the key slidably engages the socket. The spring loaded detent assembly is proximally located near the distal portion of the shank body being designed to operationally engage the outer engagement surface of the engagement plate when the lower surface of the flat head engages the inner surface of the engagement plate and maintains the key in a desired position. The traverse hole extends through the proximal portion of the shank body.

It is at least one of the present embodiments to provide a socket and a key being comprised of one or more metals.

It is still a further aspect of at least one the present embodiments to provide for a method of using a socket tool set comprising the steps of: providing a socket tool set comprising a plurality of individual sockets with varying diameters and lengths coaxially nested within one another, and a key which is slidably engaged with said sockets during storage, said key operationally engaging an individual socket and serving as an extension to said socket during use; disengaging the key from its stored position within the inner most nested socket; separating the sockets from their coaxially nested configuration so that each socket is individually accessible; matching a selected socket which has an appropriate size to engage a fastener or sparkplug; inserting the key into the selected socket; engaging the selected socket with the fastener or the spark plug; and rotating the key so that rotational torque can be applied to the socket to remove the fastener or sparkplug from its secured position or to insert the fastener or sparkplug into its secured position.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, Which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
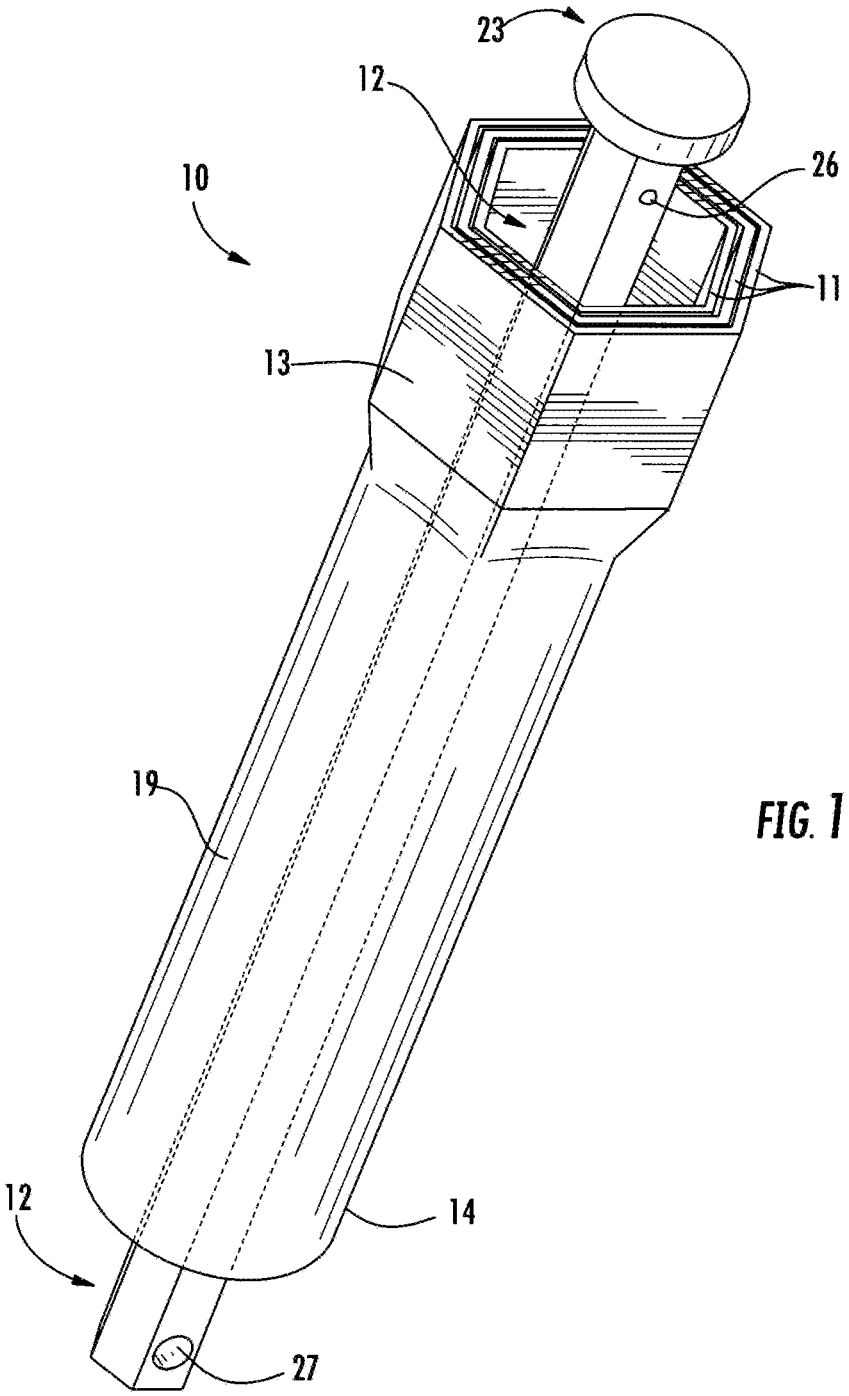
FIG. 1 is a perspective view of the socket tool set showing a plurality of nested sockets with a key in their stored configuration.
Figure 2:
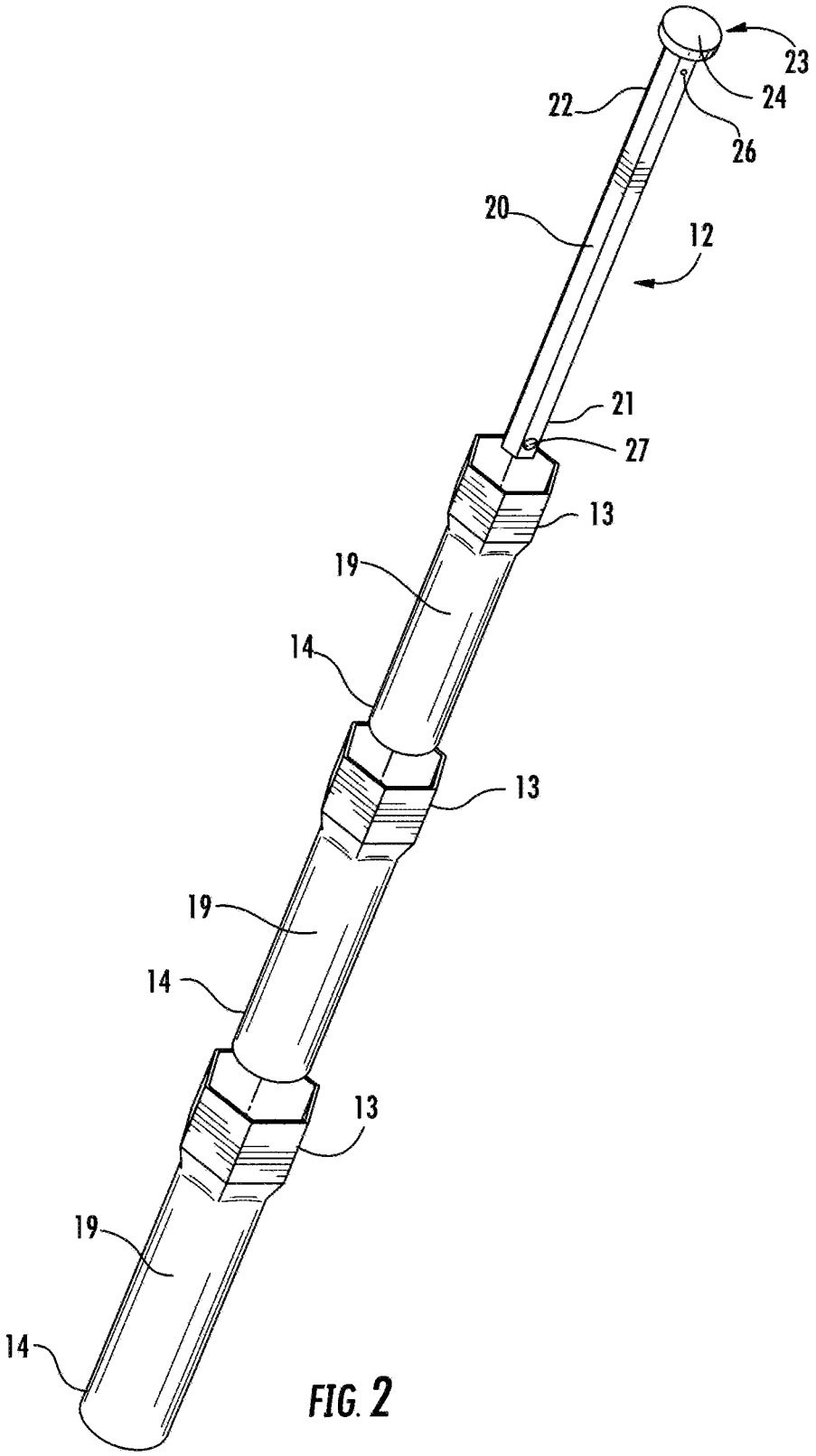
FIG. 2 is an exploded perspective view of FIG. 1 showing a plurality of sockets and a key.
Figure 3:
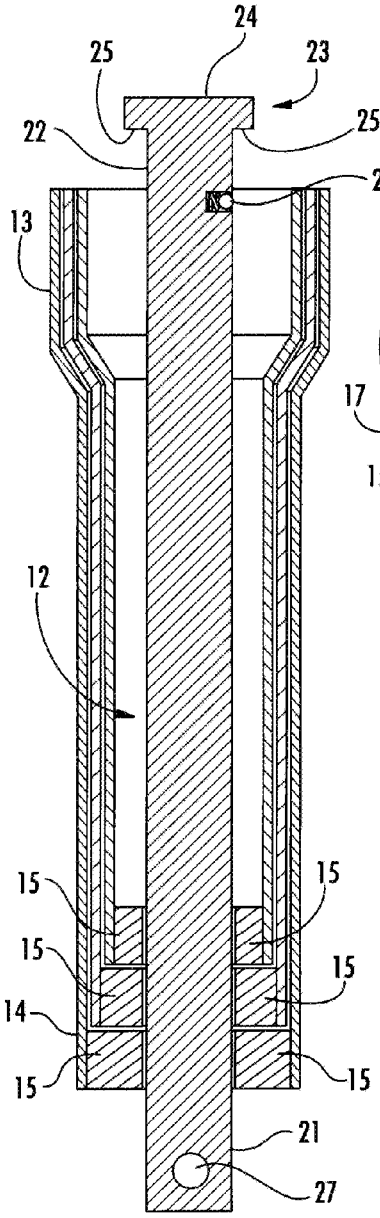
FIG. 3 illustrates a cross sectional view of a plurality of nested sockets with a key in their stored configuration.
Figure 4A:
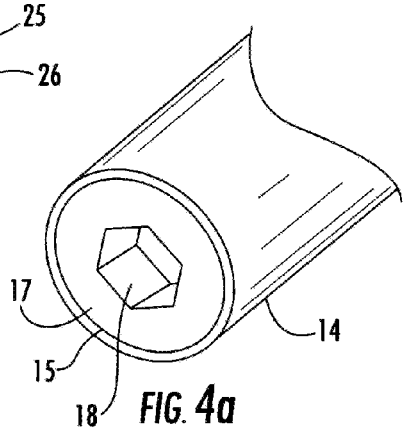
FIG. 4*a* illustrates a perspective view of the distal end of a socket.
Figure 4B:
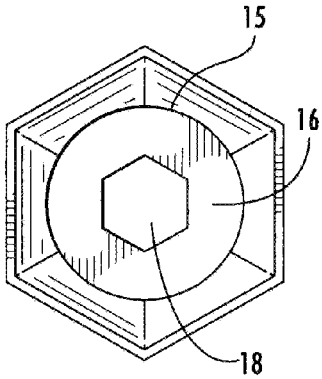
FIG. 4*b* illustrates a top view of an individual socket.
Figure 5:
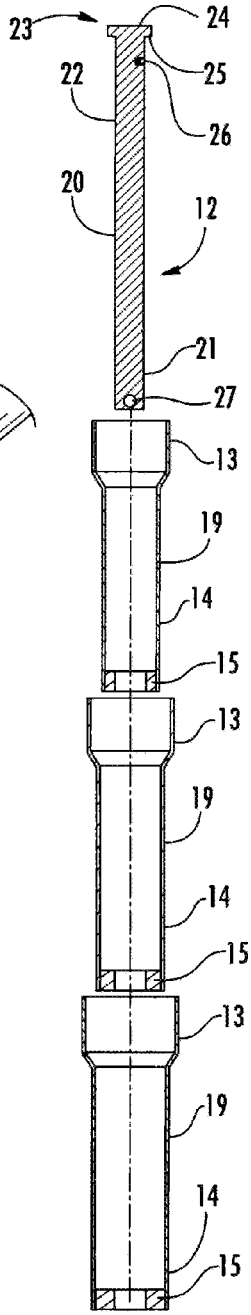
FIG. 5 is an exploded view of a plurality of nested sockets and a key illustrating the co-axial alignment of the sockets and key.
Figure 6:
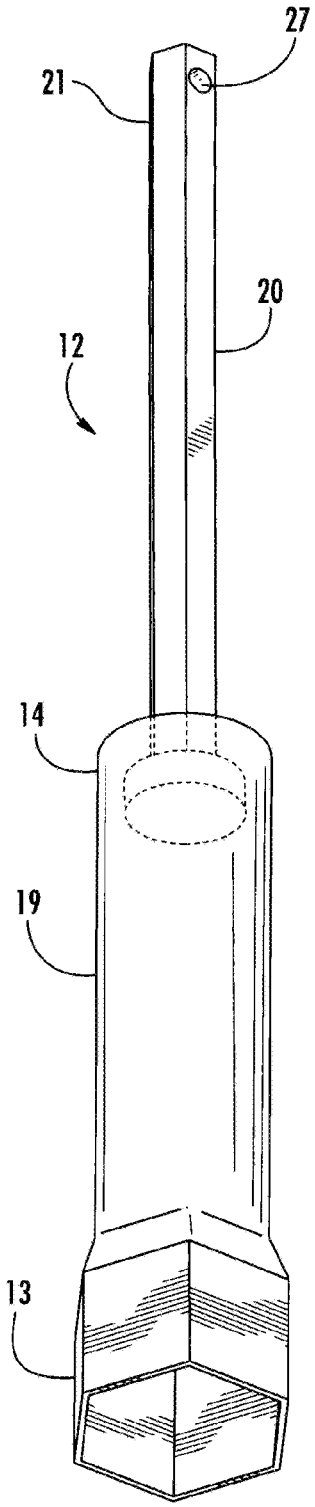
FIG. 6 is a perspective view of an individual socket with a key engaged for use.
Figure 7:
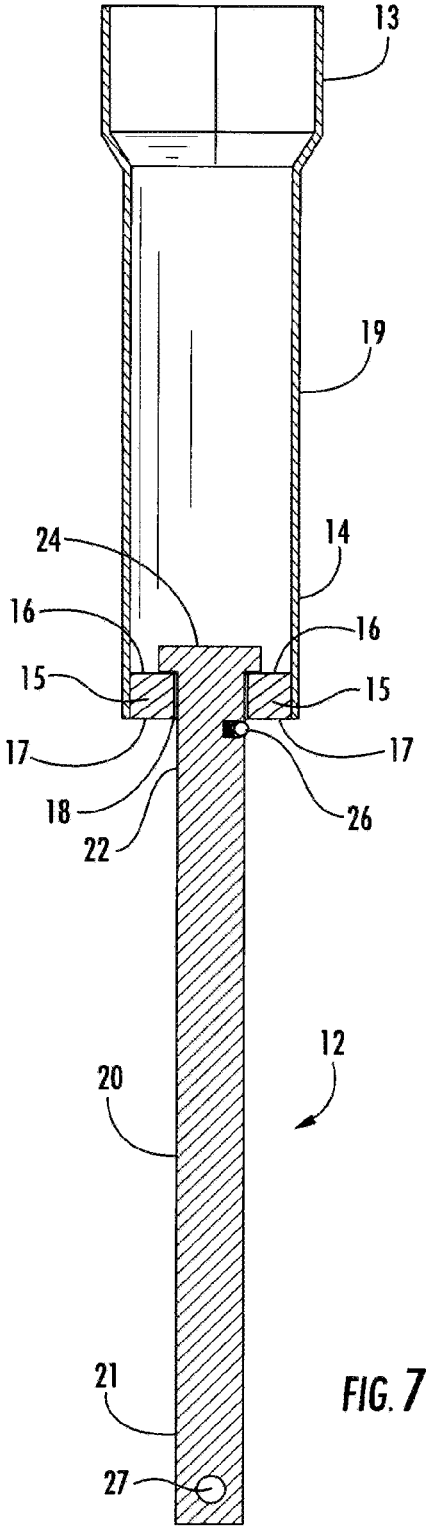
FIG. 7 is a cross-sectional view of FIG. 6.

As seen in reference to FIGS. 1 to 7, a socket tool set 10 is provided. In accordance with the present invention, FIG. 1 shows a socket tool set comprising a plurality of individual sockets 11 that are coaxially nested within one another. FIG. 5 illustrates the coaxial alignment of a key 12 with a plurality of sockets. The number of sockets nested within one another and the specific widths and lengths of the individual sockets may vary depending on the need of the user. Referring to FIGS. 1 and 3, a key 12 is slidably engaged with the nested sockets during storage. During use the key operationally engages an individual socket and serves as an extension. The socket and key may be made of one or more kinds of metal, or any other material, that can provide the necessary strength to tighten or loosen fasteners, electronic sensors, or sparkplugs using the present invention. For purposes of the present invention fasteners include common place fasteners such nuts and bolts found in most hardware stores, as well as such other devices which are used to secure one component to another. The present invention can also be used to tighten or loosen sparkplugs of various kinds and uses, such as, but not limited to those used in vehicles such as automobiles, motorcycles, recreational vehicles, all-terrain vehicles, boats, and aircraft, as well as farm and garden equipment and vehicles. Fasteners also includes various kinds of electronic sensors such as those found in the automotive, transportation industry and such sensors include oxygen sensors, oil pressure sensors, and temperature sensors.

Referring to FIGS. 1, 2, and 3, each socket includes a proximal end 13, a distal end 14, and a tubular member 19. The proximal end 13 of the socket engages devices such as fasteners, bolts, nuts, sparkplugs, and the like. Additionally, the proximal end 13 of socket may have a shape selected from the group including, but not limited to, square, pentagonal, hexagonal, heptagonal, octagonal, or any other shape known in the art of fasteners and sparkplugs. Now referring to FIGS. 4*a* and 4*b*, the distal end 14 of each socket includes an engagement plate 15 having an inner engagement surface 16 and an outer engagement surface 17. The engagement plate 15 also includes an aperture 18 which permits the key 12 to slidably and torsionally engage the socket. The tubular member 19 connects the proximal end 13 of the socket to the distal end 14 of the socket.

Referring to FIGS. 4*a*, 4*b*, 6, and 7, the key 12 includes a longitudinal shank body 20, a flat head 23, a spring loaded detent assembly 26, and a traverse hole 27. The longitudinal shank body 20 of the key extends from its proximal end 21 to its distal end 22, having a shape and a diameter that permits it to slidably and torsionally engage the aperture 18 of the engagement plate 15. The flat head 23 of the key has an upper surface 24 and a lower surface 25, with the lower surface 25 of the flat head being attached to the distal end 22 of the shank body 20. The lower surface 25 of the flat head 23 may engage the inner engagement surface 16 of the engagement plate 15 when the key slidably engages the socket. The spring loaded detent assembly 26 of the key is proximally located near the distal portion of the shank body. It is designed to operationally engage the outer engagement surface 17 of the engagement plate 15 when the lower surface 25 of the flat head 23 of the key engages the inner surface 16 of the engagement plate 15 and maintains the key in a desired position. The engagement of the outer surface 17 of the engagement plate by the spring loaded detent assembly 26 holds the socket in position during use and maintains maximum extension of the key. The traverse hole 27 in the key extends through the proximal portion 21 of the shank body of the key.

In one embodiment of the present invention the plurality of the sockets include dimensions to fit most standard sparkplugs wherein an inner socket having an inner diameter of about 16 mm and a length of about 2½ inches; a middle socket having an inner diameter of about 18 mm and a length of about 2¾ inches; an outer socket having an inner diameter of about 13/16 inches and a length of about 3 inches; and the key being hexagonal in shape having a length of about 4 inches and a diameter of about 10 mm.

In another embodiment the plurality of said sockets include dimensions that can be easily adapted to a nesting configuration wherein a first inner socket having an inner diameter of about ½ inches and a length of about 2¼ inches; a second inner socket having an inner diameter of about ⅝ inches and a length of about 2½ inches; a third inner socket having an inner diameter of about ¾ inches and a length of about 2¾ inches; a fourth outer socket having an inner diameter of about 13/16 inches and a length of about 3 inches; and the key being hexagonal in shape having a length of 4 inches and a diameter of ⅜ inches.

The present invention also includes a method of using a socket tool set 10 comprising the steps of: providing a socket tool set comprising a plurality of individual sockets with varying diameters and lengths coaxially nested within one another (see FIGS. 1, 3, and 5), and a key 12 which is slidably engaged with the sockets during storage and operationally engages sockets individually during use and serves as an extension; disengaging the key from its stored position within the inner most nested socket; separating the sockets from their coaxially nested configuration so that each socket is individually accessible; matching a selected socket which has an appropriate size to engage a fastener or sparkplug; inserting the key into the selected socket; engaging the selected socket with the fastener or the spark plug; and rotating the key so that rotational torque can be applied to the socket to remove the fastener or sparkplug from its secured position or to insert the fastener or sparkplug into its secured position.

Referring to the method described above, in one embodiment, each socket may include a proximal end 13 to engage devices such as fasteners, bolts, nuts, sparkplugs, and the like; a distal end including an engagement plate with an aperture to receive the key permitting the key to slidably and torsionally engage the socket, the engagement plate 15 having an inner engagement surface 16 and an outer engagement surface 17; and a tubular member 19 connecting the proximal end 13 of the socket to the distal end 14 of the socket. In another embodiment of the above method, the socket and the key are comprised of one or more metals. In yet another embodiment of the above method, the proximal end of the socket has a shape selected from the group including, but not limited to, square, pentagonal, hexagonal, heptagonal, octagonal, or any other shape known in the art of fasteners and sparkplugs.

In one embodiment of the above method, the key 12 includes a longitudinal shank body 20 extending from a proximal end 21 to a distal end 22, the shank body has a shape and a diameter that permits the shank body to slidably and torsionally engage the aperture 18 of the engagement plate 15; a flat head 23 with an upper surface 24 and a lower surface 25, the lower surface being attached to the distal end of the shank body 22, the lower surface 25 of the flat head may engage the inner engagement surface 16 of the engagement plate when the key slidably engages the socket; and a spring loaded detent 26 assembly proximally located near the distal portion 22 of the shank body designed to operationally engage the outer engagement surface 17 of the engagement plate 15 when the lower surface 25 of the flat head engages the inner surface 16 of the engagement plate and maintain the key in a desired position; and a traverse hole 27 extending through the proximal portion of the shank body.

In another embodiment of the above method, the plurality of the sockets include dimensions to fit most standard sparkplugs wherein an inner socket having an inner diameter of about 16 mm and a length of about 2½ inches; a middle socket having an inner diameter of about 18 mm and a length of about 2¾ inches; an outer socket having an inner diameter of about 13/16 inches and a length of about 3 inches; and the key being hexagonal in shape having a length of about 4 inches and a diameter of about 10 mm.

In another embodiment of the above method the plurality of said sockets include dimensions that can be easily adapted to a nesting configuration wherein a first inner socket having an inner diameter of about ½ inches and a length of about 2¼ inches; a second inner socket having an inner diameter of about ⅝ inches and a length of about 2½ inches; a third inner socket having an inner diameter of about ¾ inches and a length of about 2¾ inches; a fourth outer socket having an inner diameter of about 13/16 inches and a length of about 3 inches; and the key being hexagonal in shape having a length of about 4 inches and a diameter of about ⅜ inches.

The previously described versions of the present invention have many advantages, including a compact size for storage when the sockets and key are in their "nesting" configuration. Regardless of how many smaller sockets are "nested" within the larger socket, the space requirement for storage of the socket tool set is no more than the space required for the largest single socket. This "nesting" feature also broadens the combinations of socket diameters that can be assembled into a particular socket tool set.

The compact size of the socket tool when an individual socket and the key are assembled for use allow the socket tool access to areas that are otherwise un-accessible to other tools, such as those that require large handles to effect rotational torque-like action. Additionally, the key length can be decreased by sliding its longitudinal shank body into the socket's internal chamber if necessary for use in areas of limited access.

When an individual socket and the key are configured for use, the spring loaded detent assembly urges the inner surface of the engagement plate against the lower surface of the flat head of the key so that the socket remains positioned at the distal end of the key which in turn facilitates the engagement and mating of the socket with devices such as fasteners, sparkplugs, or electronic sensors. This configuration between a socket and the key also provides for a positive extraction system that prevents the accidental, or otherwise, disengagement of the socket from the key during use.

The ability of the key to exist in various lengths and dimensional width shapes, including hexagonal and octagonal, is advantageous. The various dimensional shapes of the key provide that rotational torque to turn the key can be applied by various means, including boxed-end wrenches and open-end wrenches, that other sockets, extensions, ratchets, or torque wrenches can be connected to the key. Additionally, the key may be made in various lengths depending on user and job needs.

Another advantage of the present invention is the cost to manufacture the socket tool set. The simple design of the sockets, the key, and the engagement plate decreases manufacturing costs and broadens the kinds of metals, or non-mental materials, that may be used to manufacture the socket tool set.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein.

That which is claimed:

1. A socket tool set comprising:

a plurality of individual sockets with varying diameters and lengths coaxially nested within one another, wherein said nested inner sockets are of decreasing length and diameter being equal to or less than the inner length of said outer most socket; and a key which is slidably engaged with said sockets during storage, said key operationally engaging an individual socket and serving as an extension to said socket during use, said key having a longitudinal shank body extending from a proximal end to a distal end, the shank body having a shape and a diameter that permits said shank body to slidably and torsionally engage the aperture of the engagement plate;

a flat head having an upper surface and a lower surface, said lower surface being attached to said distal end of the shank body, said lower surface of said flat head engaging the inner engagement surface of the engagement plate when the key slidably engages said socket;

a spring loaded detent assembly proximally located near the distal portion of the shank body designed to operationally engage the outer engagement surface of the engagement plate when said lower surface of said flat head engages the inner surface of said engagement plate and maintain said key in a desired position; and a traverse 20 hole extending through the proximal portion of said shank body with said longitudinal shank body operationally engaging an individual socket and serving as an extension to said socket during use; and a traverse hole extending through the proximal portion of said shank body.

2. The socket tool set of claim 1, wherein each socket includes a proximal end to engage devices such as fasteners, bolts, nuts, sparkplugs, or electronic sensors;

a distal end including an engagement plate with an aperture to receive said key permitting said key to slidably and torsionally engage said socket, said engagement plate having an inner engagement surface and an outer engagement surface; and a tubular member connecting said proximal end of said socket to said distal end of said socket.

3. The socket tool set of claim 1, wherein said socket and said key being comprised of one or more metals.

4. The socket tool set of claim 2, wherein said proximal end of said socket having a shape selected from the group including, but not limited to, square, pentagonal, hexagonal, heptagonal, octagonal, or any other shape known in the art of fasteners, electronic sensors, and sparkplugs.

5. The socket tool set of claim 1, wherein the plurality of said sockets include an inner socket having an inner diameter of 16 mm and a length of 2½ inches;

a middle socket having an inner diameter of 18 mm and a length of 2¾ inches; 10 an outer socket having an inner diameter of 13/16 inches and a length of 3 inches; and the key being hexagonal in shape having a length of 4 inches and a diameter of 10 mm.

6. The socket tool set of claim 1, wherein the plurality of said sockets include a first inner socket having an inner diameter of ½ inches and a length of 2¼ inches;

a second inner socket having an inner diameter of ⅝ inches and a length of 2½ inches;

a third inner socket having an inner diameter of ¾ inches and a length of 2¾ inches;

a fourth outer socket having an inner diameter of 13/16 inches and a length of 3 inches; and the key being hexagonal in shape having a length of 4 inches and a diameter of ⅜ inches.

7. A method of using a socket tool set comprising the steps of:

providing a socket tool set comprising:

a plurality of individual sockets with varying diameters and lengths coaxially nested within one another, wherein said nested inner sockets are of decreasing length and diameter being equal to or less than the inner length of said outer most socket; and a key which is slidably engaged with said sockets during storage, said key operationally engaging an individual socket and serving as an extension to said socket during 25 use;

disengaging the key from its stored position within the inner most nested socket;

separating the sockets from their coaxially nested configuration so that each socket is individually accessible;

matching a selected socket which has an appropriate size to engage a fastener or sparkplug;

inserting the key into the selected socket;

engaging the selected socket with the fastener or the spark plug; and rotating the key so that rotational torque can be applied to the socket to remove the fastener or sparkplug from its secured position or to insert the fastener or sparkplug into its secured position.

8. The method of claim 7, wherein each socket includes a proximal end to engage devices such as fasteners, bolts, nuts, sparkplugs, or electronic sensors;

a distal end including an engagement plate with an aperture to receive said key permitting said key to slidably and torsionally engage said socket, said engagement plate having an inner engagement surface and an outer engagement surface; and a tubular member connecting said proximal end of said socket to said distal end of said socket.

9. The method of claim 7, wherein said socket and said key being comprised of one or more metals.

10. The method of claim 8, wherein said proximal end of said socket having a shape selected from the group including, but not limited to, square, pentagonal, hexagonal, heptagonal, octagonal, or any other shape known in the art of fasteners, electronic sensors, and sparkplugs.

11. The method of claim 7, wherein said key includes a longitudinal shank body extending from a proximal end to a distal end, the shank body having a shape and a diameter that permits said shank body to slidably and torsionally engage the aperture of the engagement plate;

a flat head having an upper surface and a lower surface, said lower surface being attached to said distal end of the shank body, said lower surface of said flat head engaging the inner engagement surface of the engagement plate when the key slidably engages said socket; and a spring loaded detent assembly proximally located near the distal portion of the shank body designed to operationally engage the outer engagement surface of the engagement plate when said lower surface of said flat head engages the inner surface of said engagement plate and maintain said key in a desired position; and a traverse hole extending through the proximal portion of said shank body.

12. The method of claim 7, wherein the plurality of said sockets include an inner socket having an inner diameter of 16 mm and a length of 2½ inches;

a middle socket having an inner diameter of 18 mm and a length of 2¾ inches;

an outer socket having an inner diameter of 13/16 inches and a length of 3 inches; and the key being hexagonal in shape having a length of 4 inches and a diameter of 10 mm.

13. The method of claim 7, wherein the plurality of said sockets include a first inner socket having an inner diameter of ½ inches and a length of 2¼ inches;

a second inner socket having an inner diameter of ⅝ inches and a length of 2½ inches;

a third inner socket having an inner diameter of ¾ inches and a length of 2¾ inches;

a fourth outer socket having an inner diameter of 13/16 inches and a length of 3 inches; and the key being hexagonal in shape having a length of 4 inches and a diameter of ⅜ inches.

* * * * *